US007695697B2

(12) United States Patent
D'Orazio Pessia et al.

(10) Patent No.: US 7,695,697 B2
(45) Date of Patent: Apr. 13, 2010

(54) DEVICES FOR CRUDE OIL TREATMENT AND UPGRADING

(75) Inventors: Franco D'Orazio Pessia, Calle, 44, No. 15A-45, Urbanización Canaima, Maracaibo, Estado Zulia (VE); Delfin Alberto Gomez Mijares, Maracaibo (VE); Jose Quintin Sosa Peña, Maracaibo (VE)

(73) Assignee: Franco D'Orazio Pessia (VE)

( * ) Notice: Subject to any disclaimer, the term of this patent is extended or adjusted under 35 U.S.C. 154(b) by 639 days.

(21) Appl. No.: 11/318,213

(22) Filed: Dec. 23, 2005

(65) Prior Publication Data

US 2006/0163114 A1 Jul. 27, 2006

(30) Foreign Application Priority Data

Dec. 23, 2004 (VE) ..... 04-2244

(51) Int. Cl.

| | |
|---|---|
| ***A61K 39/02*** | (2006.01) |
| *C10C 3/00* | (2006.01) |
| *B01J 19/00* | (2006.01) |
| *B01D 24/00* | (2006.01) |
| *B01D 33/00* | (2006.01) |
| *C01C 1/00* | (2006.01) |

(52) U.S. Cl. ..... 422/243; 422/198; 210/416.5; 208/39

(58) Field of Classification Search ..... 422/198, 422/243; 208/39; 210/416.5
See application file for complete search history.

(56) References Cited

U.S. PATENT DOCUMENTS 1,396,173 A 11/1921 Fenton
1,638,530 A 8/1927 Hoskins
1,749,235 A * 3/1930 Stafford et al. ..... 196/155
3,441,499 A * 4/1969 Francis, Jr. et al. ..... 208/187
3,839,176 A * 10/1974 McCoy et al. ..... 204/560
4,043,912 A * 8/1977 Bascope et al. ..... 210/776

(Continued)

FOREIGN PATENT DOCUMENTS

CA 1 152 428 8/1983

(Continued)

*Primary Examiner*—Walter D Griffin
*Assistant Examiner*—Natasha Young
(74) *Attorney, Agent, or Firm*—Merchant & Gould P.C.

(57) ABSTRACT

Liquid hydrocarbons are removed from waste pits where they exist in a free state, via physical or mechanical methods (with heat or otherwise). The pits are blinded and closed once the areas altered by confinement of the selected material have been cleaned, using clean granular material from nearby quarries or gravel pits. The bituminous mixture or liquid oil-bearing material extracted from the pits is filitered and stabilized, using heat or chemicals, by means of a Portable Crude Stabilizer Tank. After filtering thick emulsion contaminated solid debris, the remaining oil-bearing mass is preheated and immediately liquefied in a tank, using preheating coils and, optionally, injecting chemicals. Final filtration and breaking the oil-bearing emulsion down into its components occurs in a closed horizontal or tilted receptacle, lined with thermal insulation, with diameters ranging form 43 to 86 inches, and a total length of around 15, 30 or 45 feet (varying in accordance with the required treatment speed). The receptacle operates at different internal pressures, starting with atmospheric pressure, and at temperatures ranging from ambient temperature to a few degrees below steam temperature, so as not to exceed the boiling point.

3 Claims, 8 Drawing Sheets

U.S. PATENT DOCUMENTS

| | | | | | |
|---|---|---|---|---|---|
| 4,189,386 | A | * | 2/1980 | Aman | 210/235 |
| 4,805,540 | A | * | 2/1989 | Mundloch et al. | 105/358 |
| 4,925,532 | A | * | 5/1990 | Meuser et al. | 202/219 |
| 4,995,495 | A | * | 2/1991 | Krynski | 196/46 |
| 5,518,606 | A | * | 5/1996 | Mohle | 208/45 |
| 5,520,825 | A | * | 5/1996 | Rice | 210/802 |
| 5,685,218 | A | | 11/1997 | Kemper | |
| 5,826,500 | A | | 10/1998 | Kemper | |
| 5,852,062 | A | * | 12/1998 | Carpenter | 521/41 |
| 5,928,519 | A | * | 7/1999 | Homan | 210/741 |
| 5,998,640 | A | | 12/1999 | Haefele et al. | |
| 6,000,412 | A | | 12/1999 | Chan et al. | |
| 6,187,079 | B1 | * | 2/2001 | Bridger | 96/179 |
| 6,225,483 | B1 | | 5/2001 | Franke | |
| 6,319,395 | B1 | | 11/2001 | Kirkbride et al. | |
| 6,391,268 | B1 | * | 5/2002 | Berry et al. | 422/186.04 |
| 7,008,528 | B2 | | 3/2006 | Mitchell et al. | |

FOREIGN PATENT DOCUMENTS

| | | | |
|---|---|---|---|
| CA | 1 186 822 | | 5/1985 |
| CA | 1 234 351 | | 3/1988 |
| CN | 1129674 | | 8/1996 |
| CN | 1231991 | | 10/1999 |
| CN | 1458074 | | 11/2003 |
| CN | 1500760 | A | 6/2004 |
| CN | 1367146 | | 9/2004 |
| EP | 1 211 303 | A1 | 6/2002 |
| GB | 180157 | | 5/1922 |
| GB | 291475 | | 6/1928 |
| GB | 685563 | | 1/1955 |
| JP | 57-21711 | | 2/1982 |
| JP | 7-42226 | | 2/1995 |
| RO | 2 123 557 | C1 | 12/1998 |
| RO | 2 131 902 | C1 | 6/1999 |
| RO | 2 206 732 | C1 | 6/2003 |
| SU | 898047 | | 1/1982 |
| SU | 1027195 | A | 7/1983 |
| SU | 1632456 | A1 | 3/1991 |
| WO | 97/03577 | | 2/1996 |

* cited by examiner

DEVICES FOR CRUDE OIL TREATMENT AND UPGRADING

SUMMARY

Generally speaking, environmental waste found in oil and/or natural gas production fields is caused by the very activities involved in hydrocarbon exploration and mining, such as mechanical operations at wells (drilling, repairs, servicing and/or reinstallation for various artificial surveying methods) and production testing, as well as cleaning, maintenance and/or rebuilding of ground-level and production installations, among others. This waste accumulates in common pits, also known as waste ponds or simply pits, which contain large amounts of liquid effluents comprised of medium and heavy crude oil components, bitumen, free water (untreated, unfit for human consumption, and generally in an emulsion with crude oil), and certain solids, incidentally polluted with the aforesaid hydrocarbons, which cause corresponding damage to the surrounding areas, soil and communities.

Once the oil-bearing residue stored in these waste pits, generally as a liquid or semi-solid, is recovered by proper environmental restoration methods, it can be used to manufacture asphalt mixtures suitable for building and asphalting urban or extra-urban streets or rural roads, by applying the Devices for Crude Oil Treatment and Upgrading as described in this Descriptive Report, which comply with every current national and international regulation, with regard to the environment as well as road building.

To apply these Devices correctly, the waste pits containing suitable materials must first be selected in the proper manner. Such requires that they be initially inspected and analyzed so as to examine, assess and grade this waste, as well as to duly quantify the hydrocarbons found in these pits. Once the parameters that characterize the oil-bearing liquids and solids contained in these pits have been determined, it is recommended that usable material be selected, in a liquid or semi-solid state, and that the Devices be applied for purifying, dewatering, fluidizing and breaking it up, in order to make it ready and suitable for the uses referred to above.

In this way, the oil-bearing waste found in waste pits or ponds can be fully used, along with restoring the environment and employing these oil-bearing components to build a first-rate urban infrastructure, indispensable for business and collective use. Lastly, the technical sectors involved in the Devices for Crude Oil Treatment and Upgrading include Environmental Restoration and Elimination of Environmental Waste and the Preparation of Asphalt Mixtures suitable for building roadways and other ground-level installations in hydrocarbon-producing fields and surrounding areas.

TECHNICAL BACKGROUND

Elimination of waste pits and use of the crude oil deposited in them involve highly technological activities. Any environmental restoration work carried out must be done within the corresponding legal context, which contains specific technical criteria that must be applied in order to evaluate and classify environmental impacts and ramifications, and to select the revitalization methods for restoring the soil and related vegetation properly. These standards usually contain the final specifications to be applied to environmental waste, including the respective measurement and inspection procedures. Environmental evaluations and audits that are conducted by any organization, governmental as well as private, must also be based on these technical elements and the respective legal ordinances.

Along these lines, the environmental restoration processes applied by the oil industry to oil-bearing waste pits are similar in every oilfield in the world, and refer to how each component of this liquid and solid oil-bearing waste found in these pits is treated. As concerns recovery of crude oil, technical specifications established by most oil companies, as an objective for its processing, address a maximum water and sediment content of one percent (1%). In light of the emulsifying nature of the oxidized and aged oil contained in these pits, above all those with heavy or extra-heavy crude, there can be no possibility of mixing it with freshly produced crude for dewatering. For the same reason, any measurement of the water content in the mixture, based on established standards, is inaccurate, which has led to contamination of crude batches in sales specifications, upon diluting the waste as a disposal method.

In order to recover this oil, conventional thermochemical processes applicable to heavy crude can also be used. Results of pilot testing carried out at various fields have in part been satisfactory. The cost of these methods has ranged from $5 to $25/bbl (US dollars per barrel of recovered oil), with no guarantee of crude recovery in sales specifications.

With regard to soil, the major oil companies have carried out pilot projects in the field applying biorecovery as a means of clean-up. The actual cost of this process has ranged from $30 to $60/m3 (US dollars per cubic meter of material removed). The market cost of other commercial technologies, such as thermal desorption, incineration and stabilization, is considerably higher, from $100 to $500/m3. Nevertheless, there are certain environmental limitations in instances where gas emissions are generated, or when any solution to the problem is simply put off.

The practice of filling is also foreseen in environmental regulations; however, confinement specifications result in higher costs in comparison to other alternatives.

In fact, both solid processing as well as use of the crude oil contained in waste pits are activities with a high technology content that call for major investments; however, the procedure commonly applied by most oilfield operators for environmental recovery involves only the usual blinding of existing pits.

Blinding consists of removing oil-bearing liquid and solid waste so as to free the pit itself of contamination caused by the hydrocarbons poured into it. At the same time, this waste is individually treated as follows: Liquids—water and oil, and usually emulsified—are taken to the nearest pumping station (by conveyor or pumping) to be treated, dewatered and made available in reinjection wells and/or for pumping to oil pipelines, respectively. Oil-bearing solids are sent to Handling Centers built for this purpose, where in general they become environment waste per se if they are not eventually disposed of in accordance with current environmental regulations by a scheduled time. Treatment and disposal of these materials once again requires operating outlays, making this an extremely expensive and repetitive process.

The Devices proposed in this Descriptive Report do not require compliance with such strict specifications as referred to above, with their high associated costs and low yield as observed. The equipment described in our process—once the oil-bearing residue contained in waste pits has been assessed and evaluated, and once the oil-bearing materials suitable for creating asphalt mixtures have been selected—then places them in the Crude Stabilization Tank to be subsequently processed by the Crude Treatment Device so that they can be upgraded and used in their entirety, at the same time complying with current environmental and road-building standards.

Work has also been carried out at the international level intended to improve the environment, such as techniques for manufacturing asphalt cement for use in building roadways. The following patents are particularly significant: ZEITZ HYDRIERWERK GMPH (Germany), no. DE4034321, published on May 23, 1991, wherein the inventors Erwin Kalhert et al. propose the preparation of asphalt for road paving using a mixture of bitumen and polybutadiene, gravel, sand, filling and sulfur; SMAC ACIEROID (France), no. EP0690102, published on Jan. 3, 1996, wherein the inventors Jeannot Beritzki et al. propose asphalt products with thermofusible organic binders; DEUTAG MISCHWERKE GMBH (Germany), no.

DE3729507, published on Mar. 23, 1989, wherein Kurt Ditter et al. create an environmentally-friendly process for recycling broken asphalt; MOBIL CORP (United States) U.S. Pat. No. 4,177,079, published on Dec. 4, 1979, wherein Wilton Espenschied invents a composition for asphalt pavement and a preparation method using organic solid waste; Dorozh Izyskatel, no. GB2047716, published on Dec. 3, 1980, for a proposal involving bitumen composition; Jie Yin, no. CN1080300, published on Jan. 5, 1994, for creating emulsified bentonite PRL and a method for its manufacturing; REPSOL PETROLEO SA (Spain), No. ES2069470, published on May 1, 1995, wherein the inventors Antonio Paez and Jesus Sanchez patent bitumen with a low asphaltene content, the uses and applications thereof; and NI SKIJ I POLIMERNYKH, ERIALOV, PERM Z IM S M KIROVA, No. RU2130040, published on May 10, 1999, whose inventors A. Mikov et al. create a binder for asphalt concrete mixtures.

More recently, the following works have been published during the past decade: a patent awarded to SMAC ACIEROID (France), No. FR2789419, published on Aug. 11, 2003, whereby the inventor, Jean Pierre Dean created roof lining seals with heat insulation, including granules embedded in the surface of asphalt seals that contain melted wax and elastomers; a patent awarded to TOHO CHEM IND LTD (Japan), No. EP1063263, published on Dec. 27, 2000 whose inventors (Seitaro Ando et al.) created a method for preparing paving materials using hot asphalt; a patent awarded to ROSTOVSKIJ G STR NYJ UNIVERSIT, No RU2149848, published on May 27, 2000, wherein the inventors (Bezrodnyj, O. K. et al.) invented an asphalt concrete mixture; a patent awarded to ROSTOVSKIJ G STR NYJ UNIVERSIT, No. RU2148063, published on Apr. 27, 2000, wherein Bezrodnyj, O. K. et al. created binding agents for road building; a patent awarded to INST NEFTEKHIMPERERABOTKI AKAD, RESPUB BASHKORTOSTAN K, No. RU2175037, published on Oct. 20, 2001, wherein Khisamutdinov. U. N. et al. invented an oil-polymer material for heat insulation; a patent awarded to NAJA AKADEMIJA, SAMARSKAJA G ARKHITEKTURNO STR, No. RU2174498, published on October 10, 200 [sic], wherein Nekljudov, A. G. et al. created a preparation of cold asphalt concrete with sand; a patent awarded to MATHY CONSTRUCTION COMPANY (United States), U.S. Pat. No. 6,399,680, published on Jun. 4, 2002, wherein Engber Steven and Reinke G. created a composition and preparation of modified polymer asphalt with an acid reaction; a patent awarded to FINA TECHNOLOGY, U.S. Pat. No. 6,407,152, published on Jun. 18, 2002, wherein Kelly, K. and Butler, J. created a method for preparing asphalt and polymer compounds, incorporating binding agents; a patent awarded to POLYPHALT LLC (Canada), U.S. Pat. No. 6,429,241, published on Aug. 6, 2002, wherein Liang Zhi-Zhong created bituminous compounds modified with elastomers; a patent awarded to TEXAS ENCORE MATERIALS INC (United States), U.S. Pat. No. 6,346,561, published on Feb. 12, 2002, wherein John D. Osborn (United States) proposes a type of material for pavements; and lastly, a patent awarded to UNIV LAVAL CITE UNIVERSITAIRE (Canada), U.S. Pat. No. 6,359,033, published on Mar. 19, 2002, where Abdellatif Ait-Kadi and Ali Akbar Yousefi presented their work on the composition of stable pavement with improvements for high and low temperatures. Nevertheless, all these patents differ substantially from our proposed invention.

In short, as can be seen, the aforementioned research and development work does not, fully or in part, take into consideration the overall use of oil-bearing residues obtained from the environmental cleaning of waste pits so as to convert them into material suitable for preparing asphalt mixtures to be used in the construction and paving of roads and other installations, as is clearly set forth in our process that includes Devices for Crude Oil Treatment and Upgrading, and which also provides an adequate solution for elimination of environmental waste existing in oilfields around the world.

DESCRIPTION OF THE INVENTION

The Devices for Crude Oil Treatment and Upgrading allow for full use of oil-bearing residues that coexist as environmental waste in the waste pits found in hydrocarbon-producing fields, so that they can used in making asphalt mixtures for building and paving roads, while at the same time the pits are cleaned for the environment.

This is a novel concept inasmuch the blinding of waste pits as is ordinarily done does not allow for the desired environmental restoration, since generally speaking the oil-bearing residues recovered from them are stored at temporary Handling Centers until final disposal, which so far has not been done in most cases. On the other hand, the proposed method, in addition to contributing to full environmental clean-up of the affected areas, makes it possible to use this oil-bearing waste immediately, converting it to materials suitable for building and paving roads.

Figure 1:
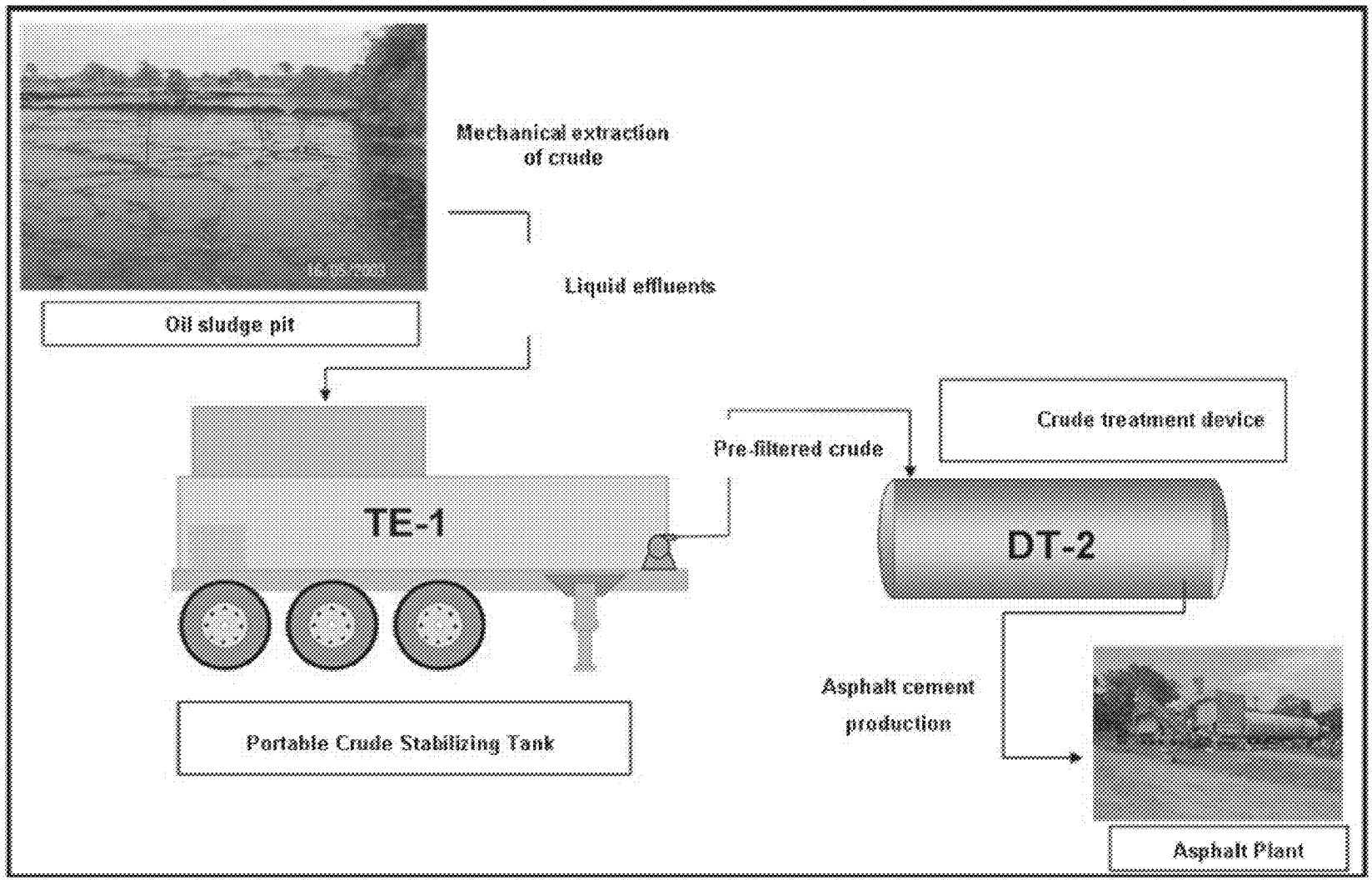
FIG. 1 is a schematic process diagram illustrating inventive aspects of the present disclosure.

The process whereby the Devices for Crude Oil Treatment and Upgrading are used as disclosed herein, once the pits containing oil-bearing waste have been assessed and selected, and the variables for determining the feasibility of preparing the aforesaid asphalt mixtures evaluated, comprises the following:

A. In order to adapt the oil-bearing mass found in waste pits, whose general process is illustrated in FIG. 1, the liquid hydrocarbons (mainly heavy or medium crude, usually emulsified) are removed from the pits where they exist in a free state, having lost their lightest and/or most volatile components to the atmosphere owing to their long exposure to the weather. Physical or mechanical methods (with heat or otherwise) are used with this method, depending on the case), employed as follows: high-flow pumps or vacuum equipment for the liquid phase, which must be properly treated and reinjected into the oilfields; and special power shovels or other heavy machinery, suitable for earth-moving, for handling the thick hydrocarbon mixture until it is processed in the Devices referred to in this Descriptive Report.

At the same time as these oil-bearing materials (hydrocarbon-impregnated liquids and solids) deposited in the waste pits are being recovered, the affected areas are cleaned up, in other words, the pits are blinded and closed once the areas altered by confinement of the selected material have been cleaned, using clean granular material from nearby quarries or gravel pits and which complies with current environmental laws, decrees and regulations.

B. The bituminous mixture or liquid oil-bearing material extracted from the pits is filtered and stabilized, using heat or chemicals, by means of the so-called Portable Crude Stabilizer Tank, equipment identified as TE-1 in this Report, a diagram of which is shown in FIGS. 2A-C.

Figure 2A:
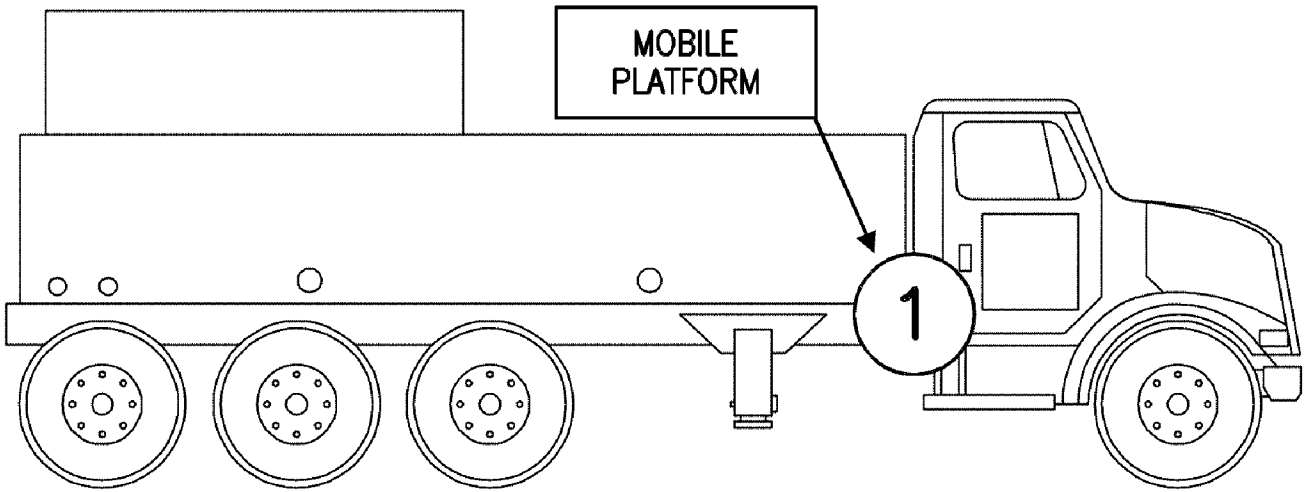
FIG. 2A is a schematic side view of a vehicle showing an example portable crude stabilizer tank according to principles of the present disclosure.
Figure 2B:
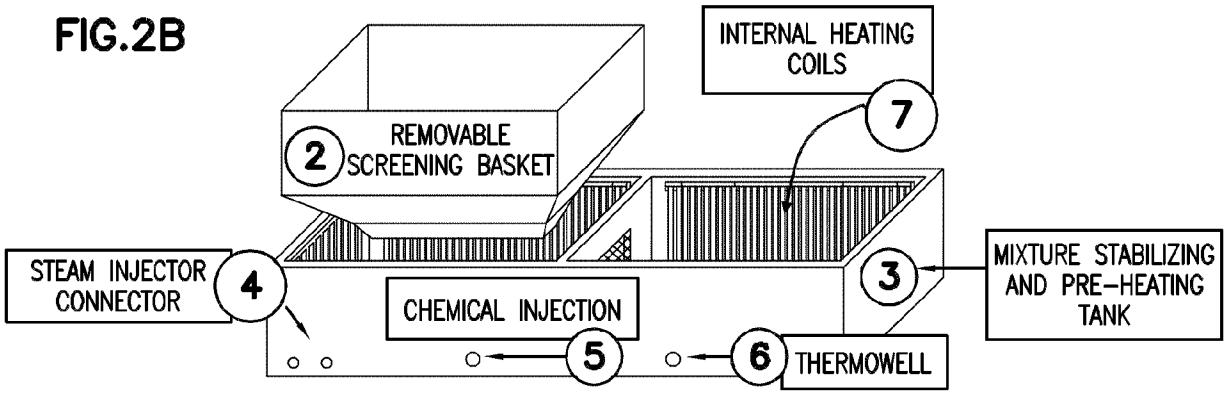
FIG. 2B is a schematic top perspective view of the portable crude stabilizer tank shown in FIG. 2*a;*
Figure 2C:
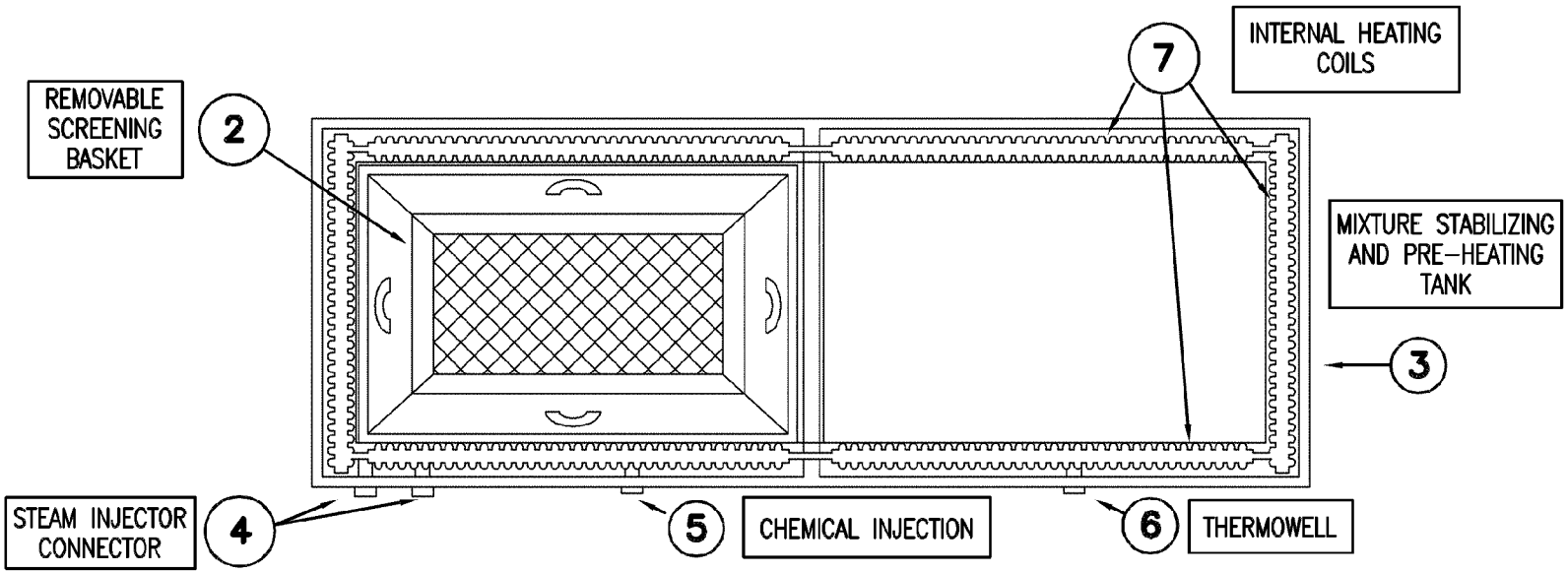
FIG. 2C is a schematic top plan view of the portable crude stabilizer tank shown in FIG. 2A.

This first device, TE-1, a diagram of which is shown in FIG. 2A, has been created, designed and assembled for carrying out this overall process. It is a physical model, completely mobile (component 1 in the aforesaid figure) used to filter the oil-bearing material that is usually contaminated with rain water, dirt, organic materials or waste in general.

The aforesaid figure shows a detail of the removable screening basket 2, which refers to a thick mesh filter for removing the thick emulsion, contaminated solids or debris mixed with the hydrocarbons, such as weeds, branches, dry leaves and other plant or animal waste, or garbage dumped by communities around the pits, which accumulates on the surface of and inside the pits over a period of time.

Once this debris has been removed—no simple task, in light of the high-viscosity of this crude and the high level of contamination with solid waste (whereby it does not flow at ambient temperature)—the remaining oil-bearing mass is preheated and immediately liquefied in the tank, using preheating coils 3, linked to a connection system 4 for initial preparation by heated means (steam injection) and/or by injecting chemicals 5 (or biological substances, or a combination of both, as the case may be), which will facilitate subsequent handling either for incorporation into the field production channels, or for use in manufacturing asphalt cement mixtures for building highways and streets. Also included is a mechanical connection 6 for a thermowell that will control the temperature of the crude in the tank, by means of a connection to an external flow control valve located on the tank steam-feed line.

FIGS. 2B-C shows a detail of the internal structure of the preheating tank 3, with the coil arrangement 7 for circulating steam (injected through the connector 4 around the oil-bearing mass, to heat and liquefy it so that it can then be upgraded. It is also possible to inject chemical or biological substances into the preheating tank 5 by mechanical means (pumping) to prepare the said oil-bearing mass using other alternative means of liquefying heavy oil.

This Crude Stabilizer Tank, TE-1, is physically located in the area where crude is recovered from the waste pits, upstream from the feed for the Device for Crude Oil Treatment, whose detail is shown in the aforementioned FIG. 1.

C. Once the mixture of hydrocarbons recovered from the pits has been filtered, purified, preheated and liquefied, it passes through the Crude Oil Treatment Device for final upgrading.

This device, known as DT-2, was designed and calculated for final filtration and to keep the hydrocarbon mixture hot. Its main function is to break the oil-bearing emulsion down into its components, dividing them into two different currents for final disposal, as well as finally removing the interstitial particles (sand and/or sediment) contained in said mixture by means of a finer filter for removing these impurities, which, as mentioned above, have become incorporated into the crude oil mass in the pits over time.

Figure 3:
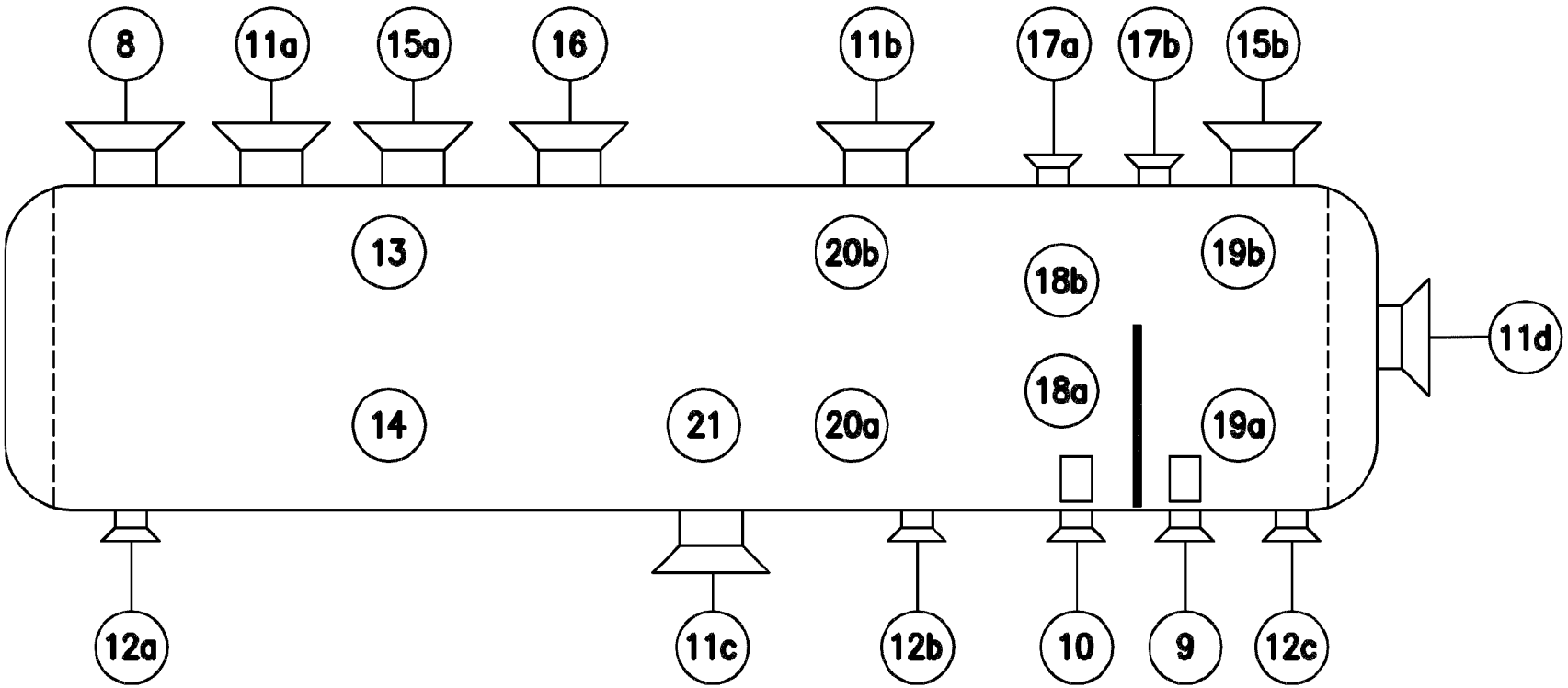
FIG. 3 is a schematic side view of an example reactor according to principles of the present disclosure.

FIG. 3 shows a sequential detail of the structure of this reactor, self-transportable and incrementally adjusted. The DT-2 has been designed for processing a flow of liquids from 6.0 to 18.0 m3/hr., preheated to a temperature slightly less than that of steam. This design contemplates that the crude to be processed will have a water content of 30%; however, mixtures with content of up to 60% or more can be processed. At the indicated processing rate and preset operating temperature, it is estimated that the crude will separate out of the water totally during the time of passage inside the device, that any emulsions will be broken up, interstitial particles will be separated out, and that clean oil will be recovered meeting specifications once the processing is finished.

During the preheating stage in the Crude Stabilizing Tank as described in FIG. 2B, the oil-water mixture is pumped into Device DT-2. Along with this process, an additional one involving screening of the crude takes place, to remove any solids in it. Accordingly, the design calls for the use of strainer filters 36 (FIG. 4) using a basket with openings of ⅙" to 1/18" diameter, installed upstream from the inlet to the aforesaid Device.

This DT-2 is a closed horizontal or tilted receptacle, lined with thermal insulation, with diameters ranging from 43 to 86 inches, and a total length of around 15, 30 or 45 feet (varying in accordance with the required treatment speed). It operates at different internal pressures, starting with atmospheric pressure, and at temperatures ranging from ambient temperature to a few degrees below steam temperature, so as not to exceed the boiling point.

Steam-heated coils are found inside the receptacle, to reinforce heat transfer to the crude during treatment. There is also an internal filter at the inlet to the Device, reinforcing the screening system. FIG. 3 shows a schematic design of this Device DT-2, identifying its main external connections.

Outside of the Device (FIG. 3), mechanical connections for the process can be seen (at the top and bottom), which will be explain in the following FIGS. 3A-F, and side connections for instrumentation and control. The following connections are of particular importance: sightglass for measuring level of liquid 20*a/b* for the process interphase in the main section of the equipment; sightglass for measuring level of crude 19*a/b* for the last section of the equipment; temperature gauge 18*a*; pressure gauge 18*b*, and a thermowell 21 for automatic control of steam injection, based on temperature, through a connection with a flow-control valve outside the Device located on the steam feed line.

Inside the Device and fed through the inlet nozzle 8, the liquid to be treated passes through another screening stage and then through four steam-heated coils (entering the cylinder through a nozzle 13, and the outlet, also through a condensate nozzle 14 whose function is to maintain liquid temperature at the liquefying level for the oil-bearing mass during upgrading, though without reaching the boiling point of water.

The time during which the liquid is retained in the Device DT-2 makes complete physical separation of the liquid phases (crude and water) possible. At the end of the receptacle, a baffle plate 25 ensures that the crude will overflow into the final section of the Device, and that the water will be retained in the main section of the Device for extraction with a pump through a nozzle located at the bottom 10. The treated crude recovered in the final section of the Device will be sucked out by a pump through another nozzle also located at the bottom of the Device 9, which will feed a temporary Storage Tank that will keep the mixture of crude treated at the terminal temperature hot, so that it can be more adequately distributed at the asphalt processing plant where the asphalt mixture or final asphalt concrete will be prepared.

Figure 3B:
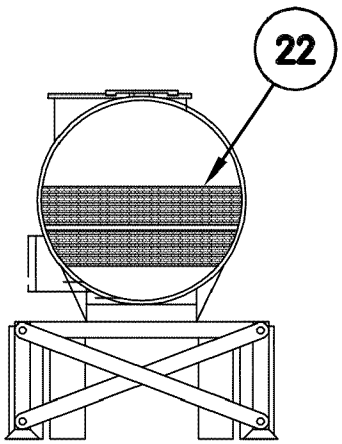
FIG. 3B is a schematic cross sectional view from the rear of the reactor shown in FIG. 3.
Figure 3A:
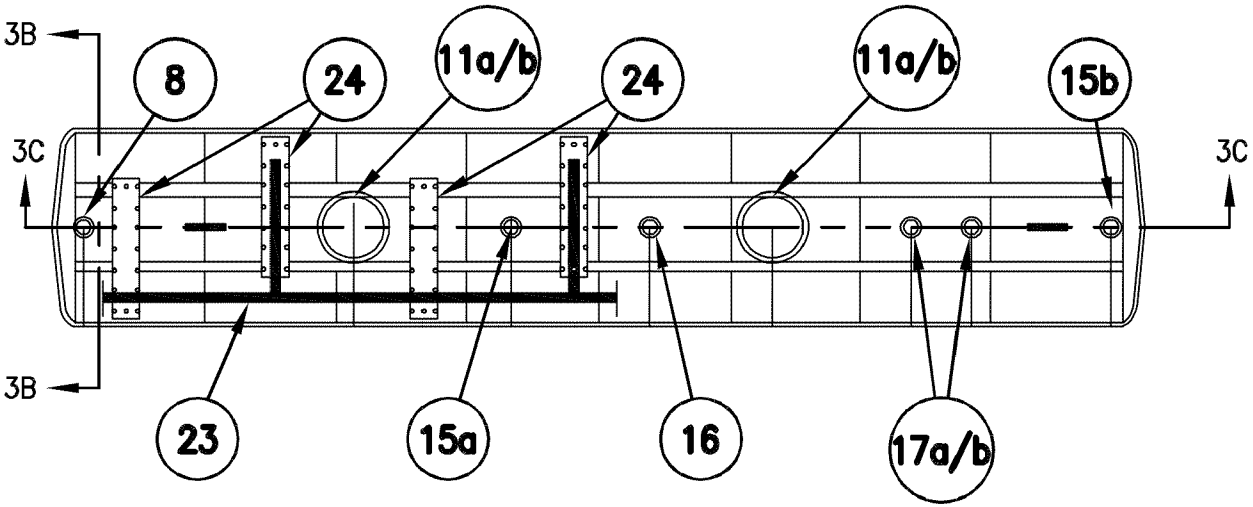
FIG. 3A is a schematic cross sectional view from above of the reactor shown in FIG. 3.
Figure 3D:
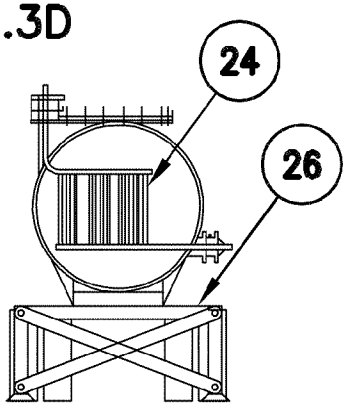
FIG. 3D is a schematic cross sectional view taken along cross sectional indicators 3D-3D of the reactor shown FIG. 3C.
Figure 3E:
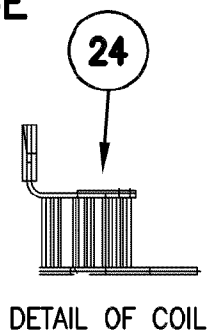
FIG. 3E is a detailed view of the coil 24 of FIG. 3D.
Figure 3C:
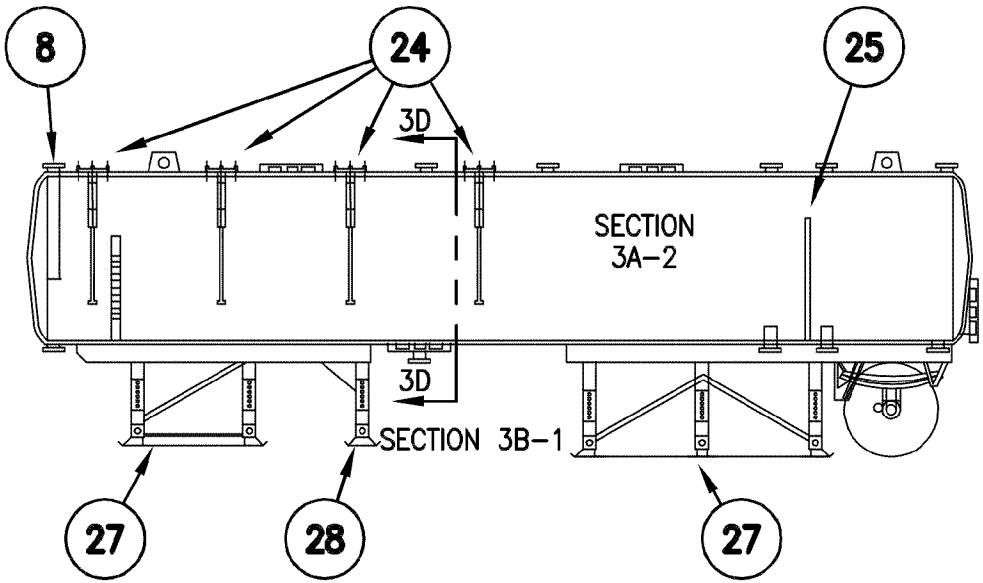
FIG. 3C is a schematic cross sectional view from a right side of the reactor shown in FIG. 3.
Figure 3F:
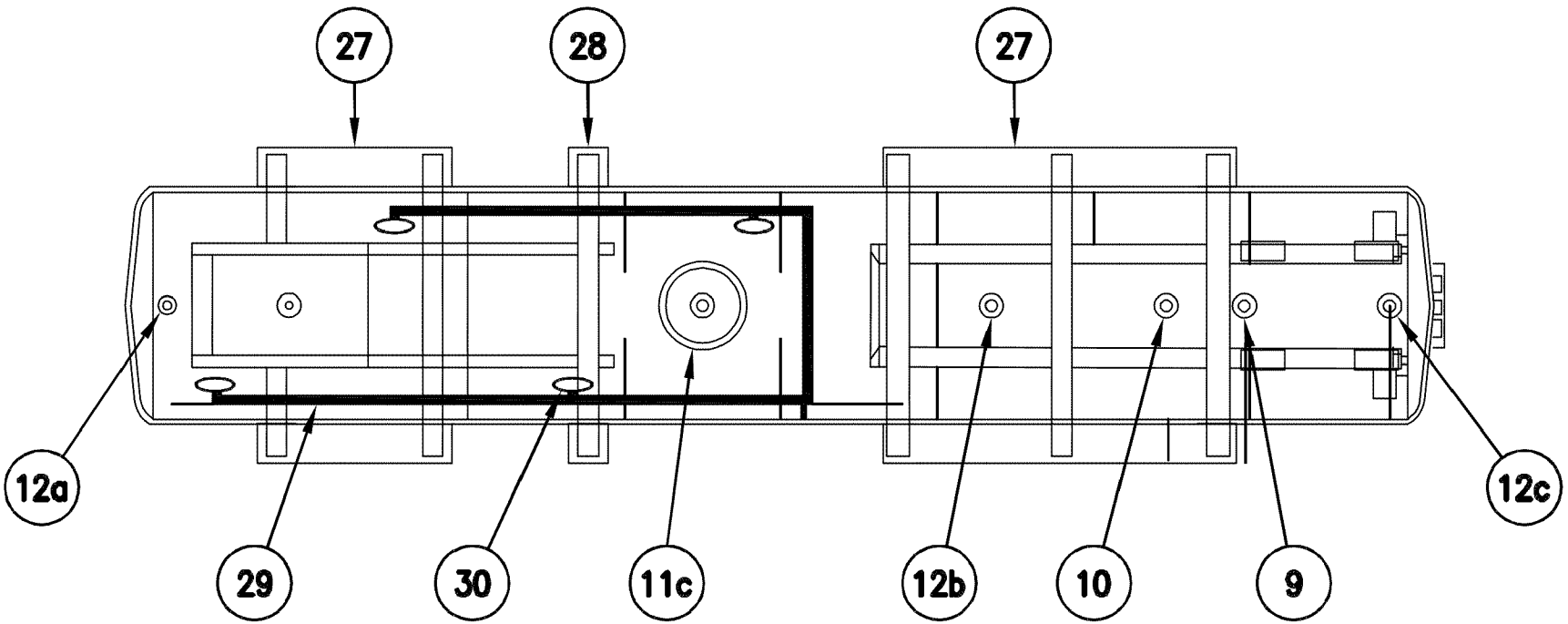
FIG. 3F is a schematic top view illustrating further features of the reactor shown in FIG. 3.

D. As a supplementary detail. FIGS. 3A-B are cross section and upper views of the DT-2, schematically showing its main components: a grooved plate for filtrates 22 (section 3B-3B); steam distribution lines going to the coils 23; steam coils 24, completely removable through the top of the Device; upper shafts for accessing the inside of the Device 11*a/b*, and insertion points for liquid-level switches 17*a/b*, for starting and stopping the crude and water pumps due to high/low levels; a ventilation and steam-outlet nozzle 15*a/b* and a pressure-relief valve 16. FIG. 3C is a longitudinal section of the Device, with a rough detail of the internal components; a grooved plate for final filtrates 22, details and location of steam coils 24 (see FIG. 3F), and a spillway plate for final separation of crude by overflow 25 as mentioned above. The side view (section 3D-3D shown in FIG. 3D), shows a detail of the heating coils 24. In addition, the wheeled chassis on which the DT-2 is mounted can be seen 26, and the extendible legs 27 with the seating shoe 28, all of which is intended to boost the stability of the Device on muddy and irregular terrain.

Lastly, FIG. 3G shows an inside view of the DT-2, with all drains 12*a/b/c* inserted for discharging water 10 and crude 9; the lower shaft 11*c*, and the connector for return of condensate produced in the row of heating coils 29, made from special tubing and welded together with guides 30 to prevent heat expansion. Each coil consists of 24 or 36 tubes (depending on the characteristics of the crude to be treated) two inches apart, when measured from center to center, and with sufficient clearance to optimize heating. As can be seen in FIG. 3, the process temperature is controlled by regulating the inlet and outlet flow. Condensate produced during the process is drained off along with the steam through the bottom of the tank, making it possible to operate only one water trap at the end and at the lowest point of the circuit.

Figure 4:
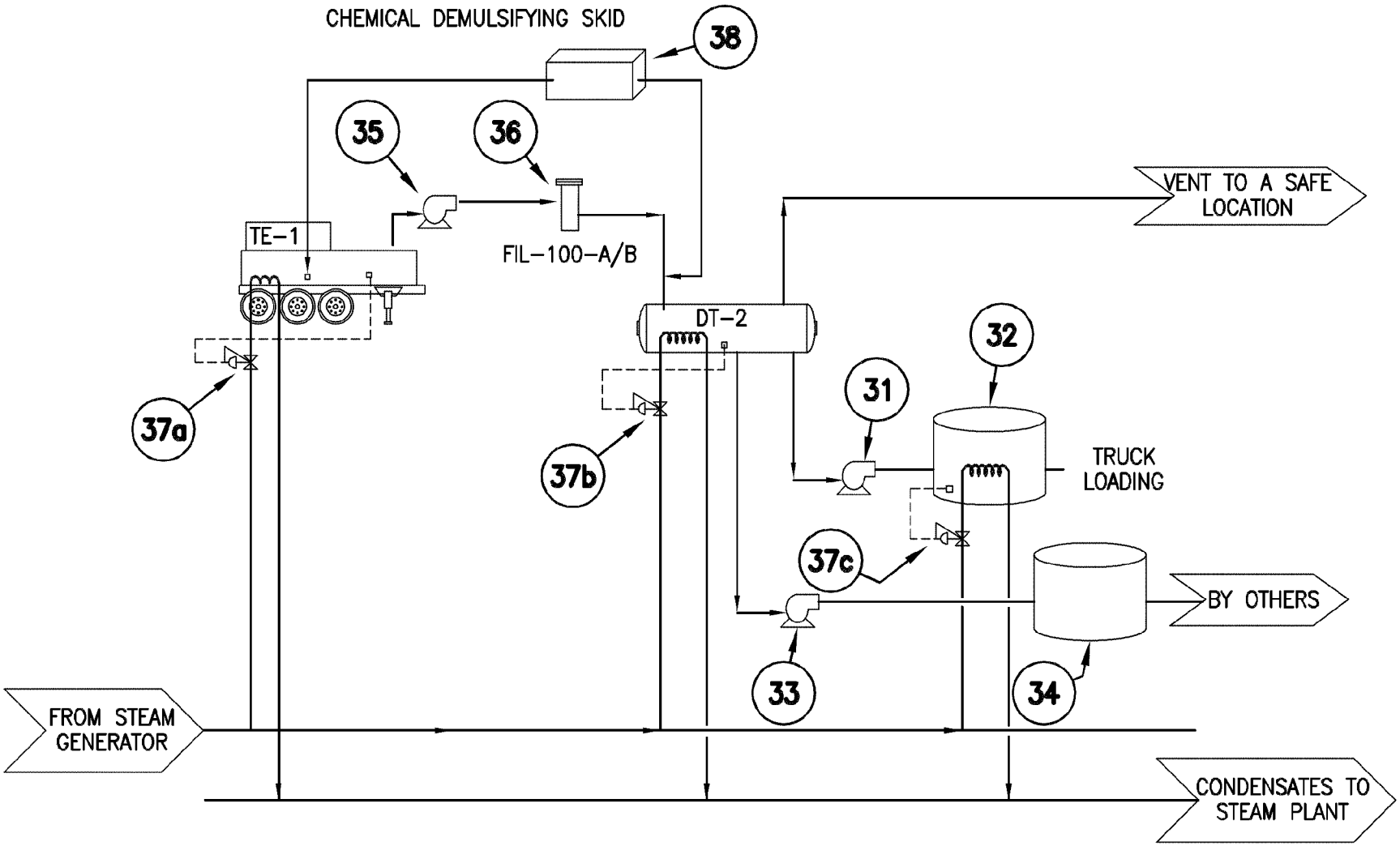
FIG. 4 is a schematic process diagram illustrating further inventive aspects of the present disclosure.

E. The Devices as a whole include pumps, measurement plates and safety devices that assist the operation and control of the dewatering process, as shown in FIG. 4. Below is a description of this figure in accordance with the systems involved therein:

System for discharging the TE-1 mixture into the DT-2, comprising a special positive displacement pump for high-viscosity oil-bearing mixtures 35, and an internal steam injection ring for connecting to the steam supply line if necessary.

A filtering system upstream from the treatment device DT-2, using strainer filters 36 with a basket with diameters ranging from ½" to 1/18".

An automatic steam flow control system based on temperature, using thermowell controls in Devices TE-1, DT-2 and the Crude Storage Tank, which are connected to flow control valves installed in the steam supply lines to these Devices 37*a/b/c*.

A crude upgrading system using injection of chemical or biological substances 38, with all of its associated connections, to facilitate the handling and treatment of recovered oil if necessary.

A system for the disposal, measurement and storage of crude, by pumping from the treatment device DT-2 into a Crude Storage Tank (which includes its own steam heating system). Once the dewatered crude is collected by overflow in the final (crude) section of the DT-2, it is discharged intermittently by the crude discharge pump 31. This operation is carried out through the corresponding level switch 17*b* (FIG. 3), which starts the pump at high levels and shuts it off at low levels. This is a rotary, gear-operated positive displacement pump, specified for handling a normal flow of 2,000 B/D (barrels of oil per day) with a flow design margin of 20%, for a maximum differential pressure of 30 PSI manometric, electric-motor driven. Said pump sends the crude to the Recovered Crude Storage Tank 32. Moreover, the discharge line has a measuring section for indicating and recording the crude.

A system for disposal and measurement of water produced, by pumping from the treatment device to a water reception tank. Water removed in the treatment device, forming the lower layer of the separator section, is discharged intermittently by the water discharge pump 33. This operation is carried out through the corresponding level switch 17*a* (FIG. 3), which creates the upper interphase between the crude and the contaminated water, along with the lower interphase of pure water, so as to start the pump at high (interphase) levels and shut it off at low levels. This is a single-stage centrifugal pump, specified for handling a normal flow rate of 3,000 B/D, with a flow design margin of 20%, for a maximum differential pressure of 30 PSI manometric, also electric-motor driven. Said pump sends the water to the Water Reception Tank 34. Moreover, the discharge line has a measuring section for indicating and recording the water.

Control, safety, and pressure-relief systems. Control links forming part of the treatment process, both manual and automatic, are comprised of the following: (i) feed pump operation; (ii) regulation of incoming flow to treatment device; (iii) temperature of Treatment Device DT-2; (iv) crude discharge pump operation; (v) operation of water discharge pump; and (vi) steam generation and return of condensate.

F. Afterward comes the use of the oil-bearing liquids recovered from the waste pits, their processing at asphalt plants for commercial use, and their use in building roads or wearing surfaces, be they asphalt concrete and/or hot sand-asphalt, suitably combined with aggregates from nearby quarries or gravel pits, which must be in the right proportion so as to comply with the specifications of The Asphalt Institute, ASTM, AASHO and Norven for building highways and access roads.

The asphalt mixtures are then manufactured at the said processing plant, which has materials at appropriate temperatures so that the oil-bearing liquids from the pits can be combined with the aggregates incorporated during the process so as to obtain the desired asphalt mixtures.

Last comes the building and paving of roads or other required installations, for which the equipment and operating processes described above are used, along with the oil-bearing materials recovered from the pits as part of this process. These operations also include processes for laying, extending and compacting the asphalt concrete or hot asphalt-sand, for which purpose the specialized machinery found in the market is used.

Even when certain procedures, tools, instruments and/or equipment used in this process are commonly used in other industrial areas, they have never before been combined in the way set forth in this Descriptive Report so that both objectives can be reached simultaneously: environmental clean-up and use of oil-bearing residues by employing the Devices for Crude Oil Treatment and Upgrading, with the added value obtained from the synergy fostered by merging these processes.

To achieve these purposes, it has been necessary to blend multidisciplinary professional know-how involving the following areas: engineering (petroleum as well as mechanical, civil and road engineering); industrial process instrumentation and control; operating experience and practices for environmental restoration; operations involving hydrocarbon-producing fields; road construction; handling and operation of asphalt producing plants. All of the foregoing is the result of the invention proposed by this new process, never before achieved in the country or elsewhere, such as is set forth in the credentials review referred to previously.

The invention claimed is:

1. A Crude Stabilizer Tank, for collecting crude oil of the type found in waste pits, comprising:

a) a removable screening basket, equipped with a thick mesh filter at the bottom, for initial filtration to remove contaminated solids and/or debris mixed with the crude oil recovered from the pits;

b) a tank with a system of interconnected coils on its inside walls, for preheating the thick mixture of filtered crude oil recovered from the pits;

c) a connecting system for initial treatment, using heat or by injecting chemicals, or a combination of both, creating a liquid oil-bearing mass; and d) a mechanical thermowell connection, for controlling the temperature of the crude oil in the tank, through a connection with an external flow control valve installed on a steam feed line.

2. A Crude Treatment Device (DT-2), comprising a closed horizontal or tilted receptacle, self-transported and lined with heat insulation, whose components separate the oil-bearing emulsion, dividing it into two different currents for final disposal and removal of solid interstitial particles contained in the oil-bearing mass, by fine filtering with grooved plates including:

a) a system with steam-heated coils, welded to each other with guides to prevent heat expansion, which reinforce heat transfer to the crude during upgrading, and maintains the mass temperature at liquefying levels;

b) a crude inlet or loading nozzle with an internal filter, for screening the crude; connecting nozzles for the steam-heating system; and recovery of remaining condensate and/or steam;

c) a deflector plate located at the bottom of the Crude Treatment Device (DT-2), so that the crude will overflow into this final section of the Device, so as to keep the water separated in the main section of the Crude Treatment Device (DT-2) to be extracted by means of a pump connected to the nozzle;

d) a nozzle located at the bottom of the Crude Treatment Device (DT-2) for connecting to the pump canying the crude mixture to the a temporary storage tank;

e) a system of lateral mechanical connections for instrumentation and control comprising: glasses for measuring liquid levels, temperature and pressure gauges, and a thermowell, for automatic control of steam injection by means of valves located on the steam feed line;

f) upper shafts for accessing the inside of the Crude Treatment Device (DT-2); and g) a wheeled chassis, on which the receptacle is mounted, with extendible stabilizing legs and seating shoes, for transporting the chassis, with increased stability of the Crude Treatment Device (DT-2) on muddy and irregular terrain.

3. A General System for Treatment, Upgrading and Storage of the crude recovered from the waste pits, including pumps, measurement plates and safety devices, for operating and controlling the dewatering process, including:

a) a positive displacement pump for high-density oil-bearing mixtures, with an internal steam injection ring, for connection to steam supply lines;

b) a filtration system upstream from a Crude Treatment Device (DT-2), using strainer filters with screening baskets;

c) an automatic steam flow control system based on temperature, using thermowell controls a Portable Crude Stabilizing Tank (TE-1) and the Crude Treatment Device (DT-2), and in a Crude Storage Tank, and which are connected to the flow control valves installed on the steam supply lines;

d) a system for disposal, measurement and storage of crude, by pumping from the Crude Treatment Device (DT-2) to the Crude Storage Tank, which includes a rotary, gear-operated, positive displacement pump, connected to a liquid level switch for discharging the dewatered crude and interconnected with discharge and pumping lines, with a measuring section for indicating and recording, up to the storage tank;

e) a single-stage, electric-motor driven centrifugal pump, connected to a water treatment device in the water reception tank, through discharge lines with a section for measuring and recording; and f) peripheral control mechanisms, safety and pressure-relief valves, incorporated into the feed pump; flow controller at treatment device inlet; temperature gauge for the Crude Treatment Device (DT-2); a crude discharge pump; a water discharge pump; and a steam generator.

* * * * *